US011262080B2

(12) United States Patent
Kim et al.

(10) Patent No.: US 11,262,080 B2
(45) Date of Patent: Mar. 1, 2022

(54) ELECTRIC OVEN

(71) Applicant: Samsung Electronics Co., Ltd, Gyeonggi-do (KR)

(72) Inventors: Kyoung-mok Kim, Yongin-si (KR); Sung-kwang Kim, Hwaseong-si (KR); Hyun-sook Kim, Hwaseong-si (KR); Jung-soo Lim, Hwaseong-si (KR); In-ki Jeon, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 437 days.

(21) Appl. No.: 16/097,097

(22) PCT Filed: Apr. 24, 2017

(86) PCT No.: PCT/KR2017/004323
§ 371 (c)(1),
(2) Date: Oct. 26, 2018

(87) PCT Pub. No.: WO2017/188678
PCT Pub. Date: Nov. 2, 2017

(65) Prior Publication Data

US 2019/0120500 A1 Apr. 25, 2019

(30) Foreign Application Priority Data

Apr. 26, 2016 (KR) ..... 10-2016-0050734

(51) Int. Cl.
*F24C 7/06* (2006.01)
*F24C 14/02* (2006.01)
(Continued)

(52) U.S. Cl.
CPC ..... *F24C 14/00* (2013.01); *F24C 7/062* (2013.01); *F24C 14/02* (2013.01);
(Continued)

(58) Field of Classification Search
None
See application file for complete search history.

(56) References Cited

U.S. PATENT DOCUMENTS 2,797,680 A * 7/1957 Nagel ..... F24C 15/16 126/19 R
4,068,572 A * 1/1978 Vogt ..... A47J 37/047 219/400
(Continued)

FOREIGN PATENT DOCUMENTS

CN 1536277 A 10/2004
DE 4007198 A1 10/1991
(Continued)

OTHER PUBLICATIONS

KR-20140069662 A, Jun. 2014, Kim, "Oven," partial translation.*
(Continued)

*Primary Examiner* — Joseph M. Pelham

(57) ABSTRACT

The present invention relates to an electric oven capable of reducing contaminants, the electric oven comprising: an oven body having a cavity capable of accommodating food therein; and a convection assembly which is installed to protrude from one surface of the cavity and which can suck and remove contaminants generated when cooking the food and can heat the inside of the cavity. The convection assembly comprises: a cover case, protruding from one surface of the cavity, including a front surface which is spaced apart from the one surface of the cavity and has an inlet port, and a side surface which extends from the front surface to the one surface of the cavity and has an outlet port; a convection fan which is installed inside the cover case and allows air containing the contaminants to be sucked into the cover case through the inlet port and discharged through the outlet port; and a convection heater for heating the air sucked into the cover case by the convection fan to remove
(Continued)

the contaminants, wherein the air discharged from the cover case moves in an upward inclined direction with respect to the one surface of the cavity.

14 Claims, 22 Drawing Sheets

(51) Int. Cl.
*F24C 14/00* (2006.01)
*F24C 15/32* (2006.01)
*F24C 15/20* (2006.01)

(52) U.S. Cl.
CPC ..... *F24C 15/2014* (2013.01); *F24C 15/325* (2013.01); *F24C 15/2007* (2013.01)

(56) References Cited

U.S. PATENT DOCUMENTS

| | | | | |
|---|---|---|---|---|
| 7,094,998 | B2 | 8/2006 | Shozo et al. | |
| 9,644,849 | B2 | 5/2017 | Lee | |
| 2002/0179587 | A1* | 12/2002 | Hui | A47J 37/0694 219/398 |
| 2003/0111069 | A1 | 6/2003 | Austin et al. | |
| 2004/0118392 | A1* | 6/2004 | McFadden | H05B 6/6473 126/21 A |
| 2004/0129692 | A1* | 7/2004 | Kim | F24C 7/087 219/400 |
| 2004/0200831 | A1 | 10/2004 | Shozo et al. | |
| 2005/0051529 | A1* | 3/2005 | Day | F24C 15/2014 219/400 |
| 2006/0289436 | A1* | 12/2006 | Carbone | F24C 15/325 219/400 |
| 2007/0095813 | A1 | 5/2007 | Sung et al. | |
| 2007/0145033 | A1 | 6/2007 | Kim et al. | |
| 2007/0295322 | A1* | 12/2007 | Dobie | A21B 1/245 126/21 A |
| 2008/0190911 | A1* | 8/2008 | Adamski | F24C 14/00 219/400 |
| 2010/0147825 | A1 | 6/2010 | Bonuso et al. | |
| 2015/0090705 | A1* | 4/2015 | Lim | F24C 15/2014 219/400 |

FOREIGN PATENT DOCUMENTS

| | | | | |
|---|---|---|---|---|
| DE | 10313916 | A1 | | 10/2004 |
| EP | 2072911 | A1 | | 6/2009 |
| JP | 2000-157424 | A | | 6/2000 |
| JP | 2013-257128 | A | | 12/2013 |
| KR | 10-2006-0039544 | A | | 5/2006 |
| KR | 10-0819592 | B1 | | 3/2008 |
| KR | 10-2010-0009858 | A | | 1/2010 |
| KR | 10-2010-0010309 | A | | 2/2010 |
| KR | 10-1220550 | B1 | | 1/2013 |
| KR | 10-2014-0069662 | A | | 6/2014 |
| KR | 20140069662 | A | * | 6/2014 |
| KR | 10-2016-0015750 | A | | 2/2016 |

OTHER PUBLICATIONS

Communication pursuant to Article 94(3) EPC in connection with European Application No. 17789862.4 dated Apr. 2, 2020, 6 pages.
International Search Report dated Jul. 24, 2017 in connection with International Patent Application No. PCT/KR2017/004323, 2 pages.
Written Opinion of the International Searching Authority dated Jul. 24, 2017 in connection with International Patent Application No. PCT/KR2017/004323, 5 pages.
European Patent Office, "Supplementary European Search Report," Application No. EP17789862.4, dated Feb. 13, 2019, 9 pages.
Communication pursuant to Article 94(3) EPC, dated Jun. 4, 2021, in connection with European Patent Application No. 17789862.4, 5 pages.

* cited by examiner

ELECTRIC OVEN

CROSS-REFERENCE TO RELATED APPLICATIONS

This application is a 371 of International Application No. PCT/KR2017/004323 filed Apr. 24, 2017, which claims priority to Korean Patent Application No. 10-2016-0050734 filed Apr. 26, 2016, the disclosures of which are herein incorporated by reference in their entirety.

BACKGROUND

1. Field

The present disclosure relates to an electric oven, and more particularly, to an electric oven having a structure capable of easily removing oil mist generated when food is cooked with the electric oven.

2. Description of Related Art

An oven is an apparatus for cooking food by heating the food. Due to the nature of the heating cooking, when the food is heated, contaminants such as water vapor, combustion oxides, oil mist, or the like are generated on the surface of the food.

Contaminants such as oil mist generated at normal cooking temperatures in the range of about 150 to 250° C. are discharged to the outside of the electric oven. However, some contaminants are attached to the inner surface of the cavity of the electric oven. Therefore, when the electric oven is used for a long period of time, contaminants such as oil mist contaminate the inner surface of the cavity, which is a major cause of odor generation.

Accordingly, the conventional electric ovens are formed to use a pyro-cleaning method and a steam cleaning method to remove such internal contamination.

In the pyro-cleaning method, the inside of the cavity is heated to a high temperature of about 400 to 500° C. to remove the contamination of the inner surface of the cavity. The contaminants attached to the inner surface of the cavity are burned and then removed. However, since the pyro-cleaning method burns contaminants by heating them at a high temperature, there is a problem that harmful gas and soot are generated.

Also, in the steam cleaning method, the inner surface of the cavity is formed of a hydrophilic material, and the contaminants attached to the inner surface are removed by using steam. This method is advantageous in that the cleaning time is shorter than that of the pyro-cleaning method and there is no generation of harmful gas and soot. However, since the contaminants strongly adhered to the inner surface of the cavity cannot be removed, there is a problem that the cleaning property is weaker than the pyro-cleaning method.

As described above, the conventional electric oven has a method of cleaning the contaminants after the inner surface of the cavity is contaminated.

However, in order to efficiently clean the oven, it is desirable to reduce the amount of contaminants before the inner surface of the cavity of the electric oven is contaminated.

SUMMARY

The present disclosure has been developed in order to overcome the above problems. An aspect of the present disclosure relates to an electric oven that can minimize contamination of an inner surface of a cavity of the electric oven by removing contaminants such as oil mist generated when cooking food with the electric oven.

Further, another aspect of the present disclosure relates to an electric oven having a structure in which contamination generated on an inner surface of a cavity of the electric oven can be easily removed.

According to an aspect of the present disclosure, an electric oven may include an oven main body forming a cavity in which food is received; and a convection assembly provided to protrude from one surface of the cavity and configured to suck and remove contaminants generated when cooking the food and to heat an inside of the cavity, wherein the convection assembly may include a cover case protruding from the one surface of the cavity, the cover case including a front surface spaced apart from the one surface of the cavity and having an inlet port and a side surface extending from the front surface to the one surface of the cavity and having outlet ports; a convection fan provided inside the cover case, the convection fan configured to allow air containing the contaminants to be sucked into the cover case through the inlet port and to be discharged through the outlet ports; and a convection heater configured to heat the air sucked into the cover case by the convection fan and to remove the contaminants, and wherein the air discharged from the cover case may move in an upward inclined direction with respect to the one surface of the cavity.

The side surface of the cover case may be inclined with respect to the one surface of the cavity.

The electric oven may include a barrier disposed between the convection heater and the side surface of the cover case, wherein the air discharged by the convection fan may collide with the barrier and then be discharged through the outlet ports.

The electric oven may include an outer barrier provided around the cover case and configured to allow the air discharged from the outlet ports of the cover case to move in an upward inclined direction with respect to the one surface of the cavity.

The convection heater may be disposed downstream of the convection fan in a flow direction of the air, and a porous member may be provided on the inlet port of the cover case or on the front surface of the cover case.

The convection heater may be disposed upstream of the convection fan in a flow direction of the air.

The electric oven may include a plurality of rack supporting protrusions provided on both side surfaces of the cavity, wherein each of the plurality of rack supporting protrusions may include at least two lower supporting protrusions provided parallel to a bottom surface of the cavity and spaced apart from each other by a predetermined interval, and an upper supporting protrusion disposed between the at least two lower supporting protrusions and spaced apart upward from the at least two lower supporting protrusions.

The electric oven may include an upper heater provided on an upper surface of the cavity; and a shield plate provided between the upper surface of the cavity and the upper heater.

A bottom surface of the cavity may be inclined downward from a rear surface of the cavity towards a front side of the cavity, and a contaminant collecting groove may be formed adjacent to both side surfaces and the rear surface of the cavity.

The electric oven may include a controller configured to control the convection heater, wherein the controller may control the convection heater so that the convection heater is heated to a maximum temperature and returned to a cooking temperature at least once while cooking the food.

According to another aspect of the present disclosure, a cover case may form a convection assembly provided to protrude from one surface of a cavity of an electric oven in which food is received and configured to suck and remove contaminants generated when cooking the food and to heat an inside of the cavity. The cover case may be formed to protrude from the one surface of the cavity and include a front surface spaced apart from the one surface of the cavity and having an inlet port and a side surface extending from the front surface to the one surface of the cavity and having outlet ports, wherein the side surface of the cover case is disposed to be inclined with respect to the one surface of the cavity so that air discharged from the outlet ports of the side surface of the cover case may flow in an upward inclined direction with respect to the one surface of the cavity.

DETAILED DESCRIPTION

Hereinafter, embodiments of an electric oven according to the present disclosure will be described in detail with reference to the accompanying drawings.

It is to be understood that the embodiments described below are provided for illustrative purpose only, and that the present disclosure may be embodied with various modifications different form exemplary embodiments described herein. However, in the following description below, detailed description of well-known functions or components will be omitted when it may be unnecessary to obscure the subject matter of the present disclosure. Further, the accompanying drawings may be not drawn to scale in order to facilitate understanding of the invention, but the dimensions of some of the components may be exaggerated.

Figure 1:
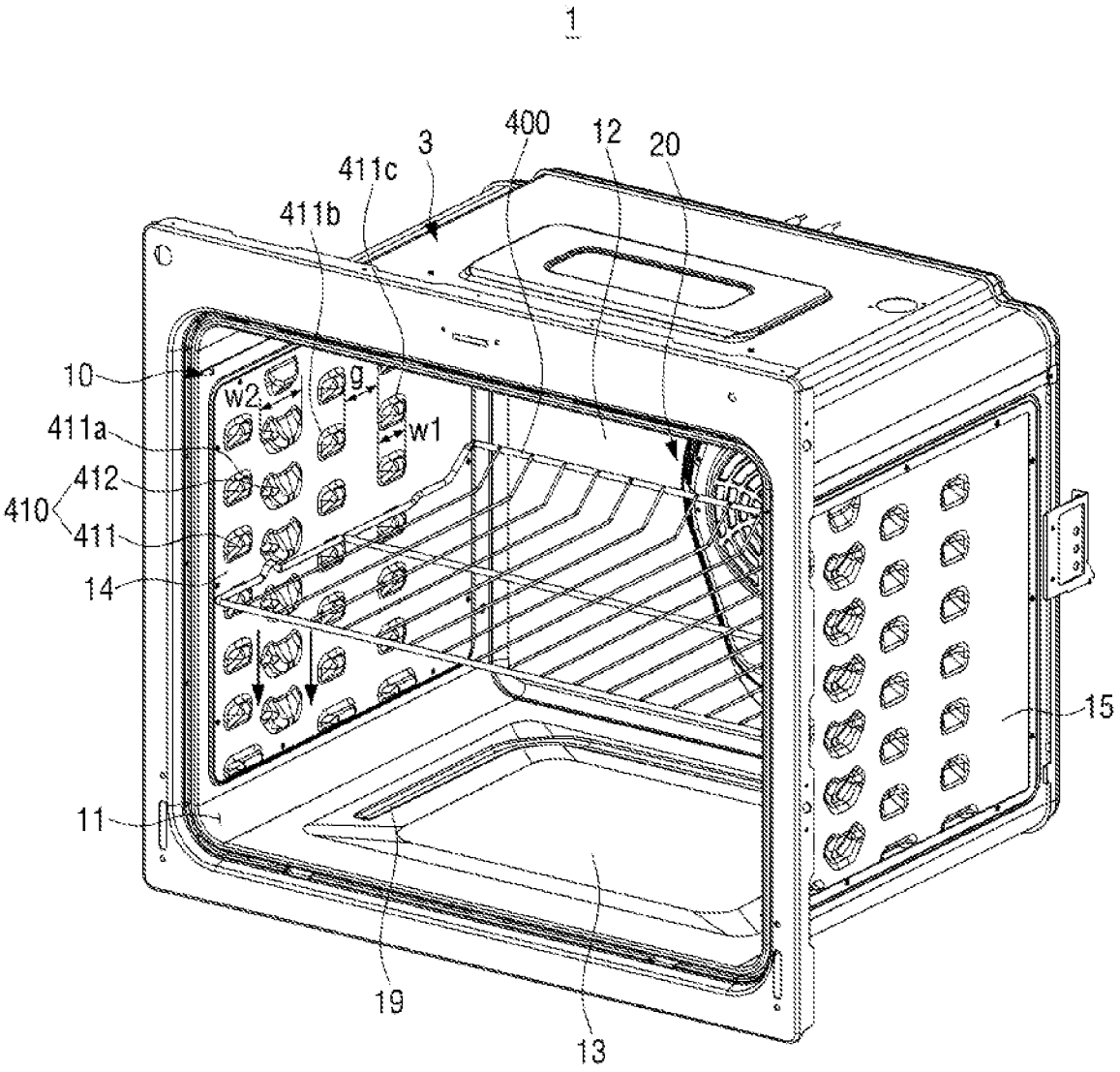
FIG. 1 is a perspective view illustrating an electric oven according to an embodiment of the present disclosure.

FIG. 1 is a perspective view illustrating an electric oven according to an embodiment of the present disclosure. For reference, FIG. 1 shows an oven main body that forms a cavity of an electric oven, and a cover which is provided outside the oven main body and forms an appearance of the electric oven and a door that opens and closes an opening of the cavity are not shown.

Referring to FIG. 1, an electric oven 1 according to an embodiment of the present disclosure may include an oven main body 3 forming a cavity 10 in which food or like is received and a convection assembly 20 disposed on one surface of the cavity 10.

The oven main body 3 is formed in a substantially hollow rectangular parallelepiped shape, and the inner space thereof forms the cavity 10. An opening 11 is formed at one side of the oven main body 3. The cavity 10 of the oven main body 3 forms a cooking space in which the food is cooked. A door (not illustrated) is provided in the opening 11 of the oven main body 3 so that a user can insert or remove the food into or from the cavity 10 through the opening 11.

The convection assembly 20 performs a function of heating and circulating air inside the cavity 10. In detail, the convection assembly 20 sucks the air in the cavity 10, heats the sucked air, and discharges the heated air into the cavity 10, thereby heating the inside of the cavity 10 to a predetermined temperature. Accordingly, the convection assembly 20 may suck and remove contaminants such as oil mist generated when cooking food, and may heat the inside of the cavity 10 to a predetermined temperature.

The convection assembly 20 is provided on one surface 12 of the cavity 10, in the case of the embodiment shown in FIG. 1, on the rear surface of the cavity 10. The convection assembly 20 is provided to protrude from the rear surface 12 of the cavity 10 to the inside of the cavity 10.

Hereinafter, the convection assembly 20 according to an embodiment of the present disclosure will be described in detail with reference to FIGS. 2 and 3.

Figure 2:
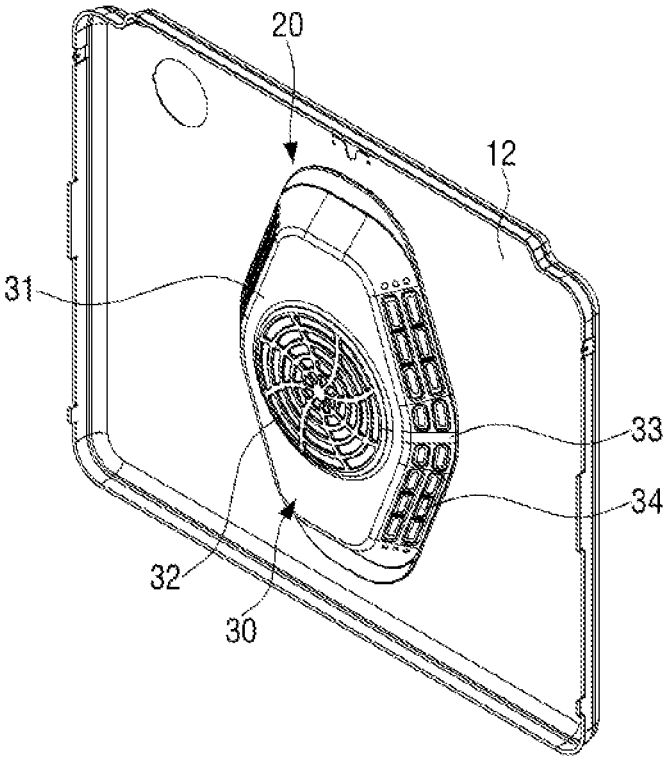
FIG. 2 is a perspective view illustrating a convection assembly provided on one surface of a cavity of an electric oven according to an embodiment of the present disclosure.
Figure 3:
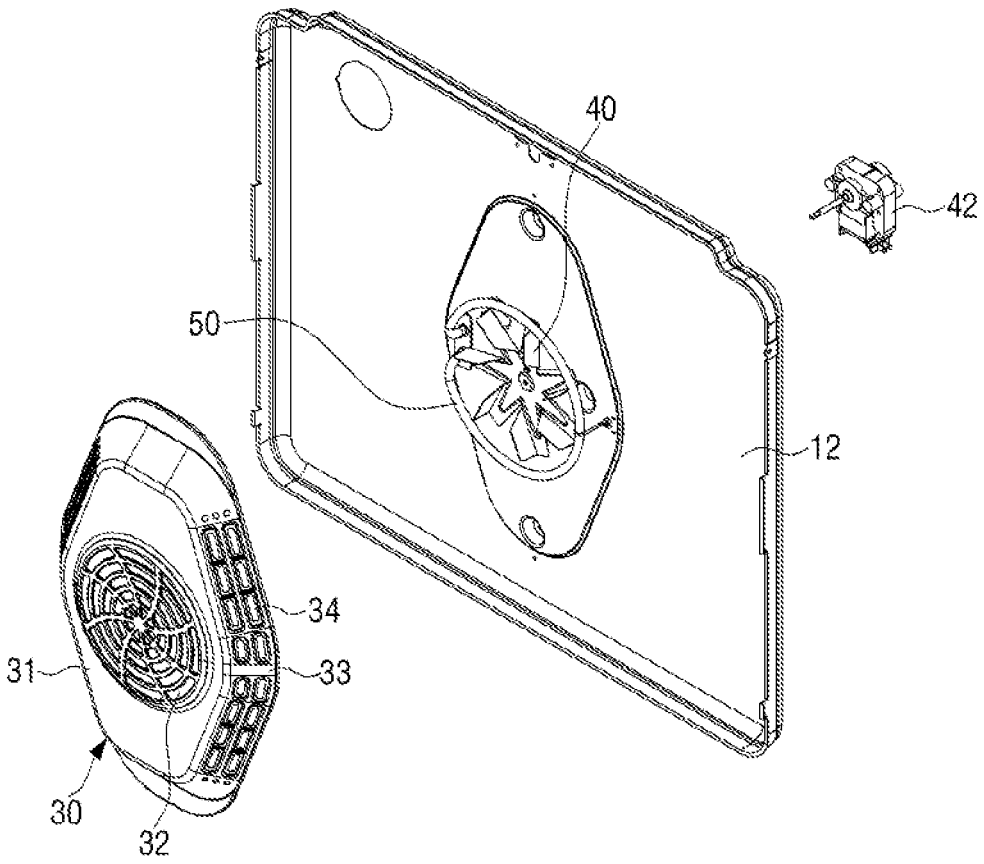
FIG. 3 is an exploded perspective view illustrating the convection assembly of FIG. 2.

FIG. 2 is a perspective view illustrating a convection assembly provided on one surface of a cavity of an electric oven according to an embodiment of the present disclosure, and FIG. 3 is an exploded perspective view illustrating the convection assembly of FIG. 2.

Referring to FIGS. 2 and 3, the convection assembly 20 may include a cover case 30, a convection fan 40, and a convection heater 50.

The cover case 30 is formed to protrude from one surface 12 of the cavity 10 so as to cover the convection fan 40 and the convection heater 50. The cover case 30 may include a front surface 31 that is parallel to the one surface 12 of the cavity 10 and has an inlet port 32 and a side surface 33 extending from the front surface 31 to the one surface 12 of the cavity 10. The side surface 33 of the cover case 30 is formed in a shape inclined at a predetermined angle with respect to the front surface 31, that is, in a shape inclined downwardly in the outward direction toward the one surface 12 of the cavity 10 from the front surface 31 as illustrated in FIGS. 2 and 3. Therefore, the side surface 33 of the cover case 30 is not at right angles with respect to the front surface 31 thereof. Also, the cover case 30 is formed in a concave container shape having the front surface as a bottom.

Figure 9:
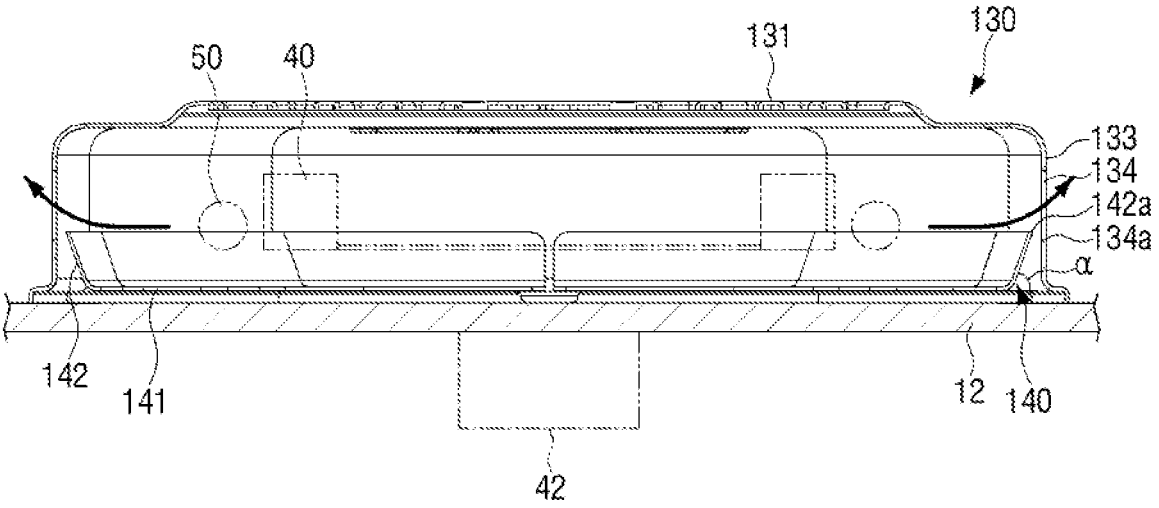
FIG. 9 is a cross-sectional view of the cover case of FIG. 8.
Figure 13:
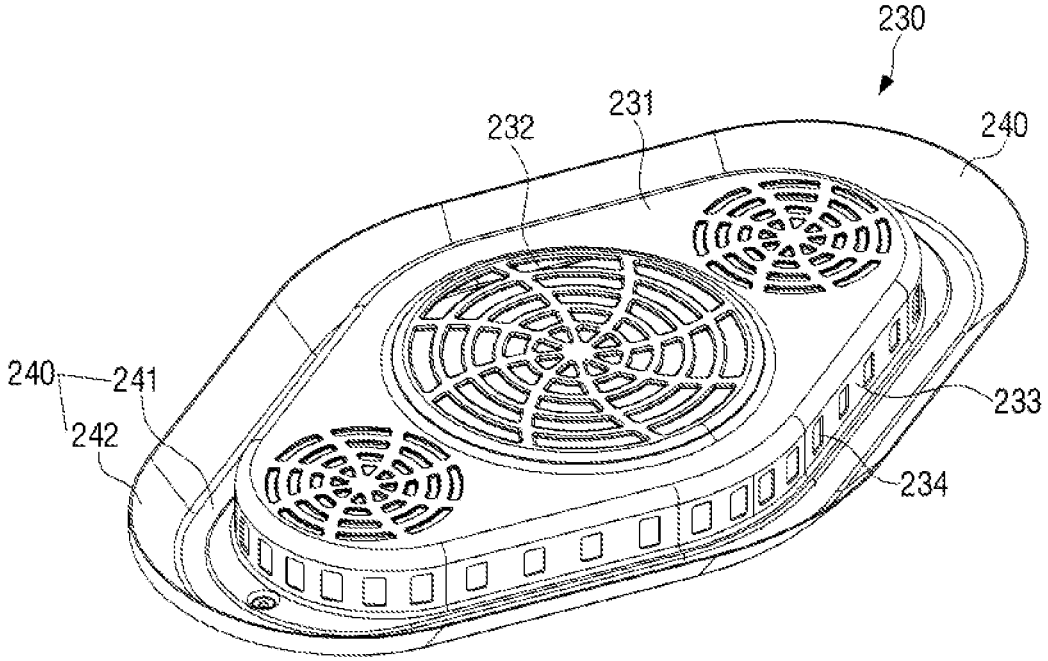
FIG. 13 is a perspective view illustrating another example of a cover case of a convection assembly of an electric oven according to an embodiment of the present disclosure.

In addition, a plurality of outlet ports 34 are provided on the side surface 33 of the cover case 30. Accordingly, the inside air of the cavity 10 is drawn into the inside of the cover case 30 through the inlet port 32 of the front surface 31 of the cover case 30, and is discharged to the outside of the cover case 30 through the plurality of outlet ports 34 provided on the side surface 33 of the cover case 30. The inlet port 32 may be formed with a plurality of holes through which the air can pass. In the case of the embodiment shown in FIGS. 2 and 3, the cover case 30 is provided with a single inlet port 32, but a plurality of inlet ports 32 may be provided as illustrated in FIGS. 9 and 13.

Figure 4:
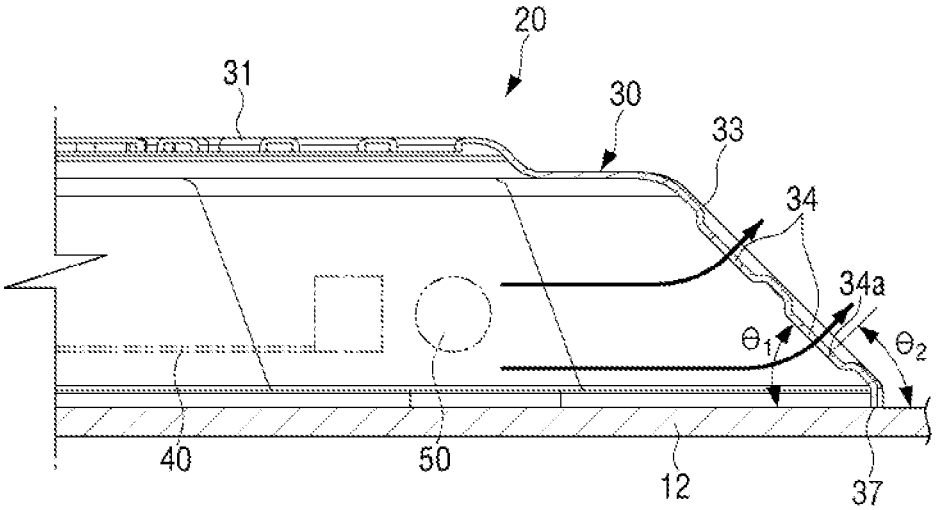
FIG. 4 is a partial cross-sectional view illustrating a cover case of a convection assembly of an electric oven according to an embodiment of the present disclosure.

FIG. 4 is a partial cross-sectional view illustrating a cover case of a convection assembly of an electric oven according to an embodiment of the present disclosure.

Referring to FIG. 4, the side surface 33 of the cover case 30 in which the outlet ports 34 are formed is formed to be inclined at a predetermined angle θ1 with respect to the one surface 12 of the cavity 10. Therefore, the inner surface of the outlet port 34 formed in the inclined side surface 33 is inclined at a predetermined angle θ2 with respect to the one surface 12 of the cavity 10. In other words, the side surface 34*a* of a hole forming each of the outlet ports 34 is inclined downwardly at a predetermined angle θ2 toward the bottom surface 36 of the cover case 30. Accordingly, the air discharged from the inside of the cover case 30 is discharged upwardly with respect to the one surface 12 of the cavity 10 on which the cover case 30 is disposed.

When the outlet ports 34 of the cover case 30 is formed as described above, the air discharged from the cover case 30 does not come into direct contact with a portion of the one surface 12 of the cavity 10 around the cover case 30. Accordingly, even when contaminants are contained in the air discharged from the cover case 30, the contamination of the inner surface 12 of the cavity 10 caused by the accumulation of contaminants around the cover case 30 may be minimized.

The convection fan 40 is disposed inside the cover case 30 and serves to suck the air inside the cavity 10 into the inside of the cover case 30 and to discharge it to the outside thereof. In other words, the convection fan 40 allows the air containing contaminants such as oil mist to be sucked into the inside of the cover case 30 through the inlet port 32 of the cover case 30 and allows the sucked air to be discharged to the outside through the outlet ports 34 of the cover case 30. Accordingly, the convection fan 40 functions to circulate the air inside the cavity 10. The convection fan 40 is configured to suck air in the center thereof and discharge air in a radial direction thereof. The convection fan 40 is rotated by a motor 42 provided behind the one surface 12 of the cavity 10.

The convection heater 50 heats air to a predetermined temperature. At this time, contaminants contained in the air may be burned and removed. In detail, when the inside air of the cavity 10 is sucked into the cover case 30 by the convection fan 40, the sucked air is heated by the convection heater 50. When the convection heater 50 heats the sucked air, the contaminants such as oil mist contained in the air are removed.

The convection heater 50 is disposed downstream of the convection fan 40. In detail, the convection heater 50 is disposed around the convection fan 40 so as to surround the convection fan 40. Accordingly, the air inside the cavity 10 is drawn in through the inlet port 32 of the cover case 30, passed through the convection fan 40 and the convection heater 50 in order, and then discharged to the outside through the outlet ports 34 of the cover case 30. Therefore, while the air discharged from the convection fan 40 passes by the convection heater 50, the contaminants contained in the air are removed, and the temperature of the air is increased.

The convection heater 50 may use any one of various types of heaters as long as it can increase the temperature of the air. In the case of the embodiment shown in FIG. 3, the convection heater 50 is formed in a circular shape by bending a bar or rod heater configured to generate resistance heat. However, the shape of the convection heater 50 is not limited thereto.

Figure 5:
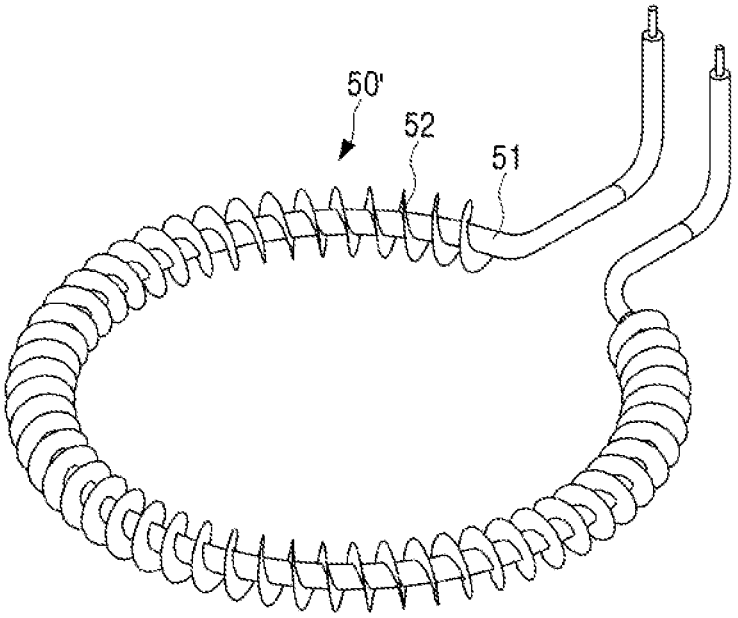
FIG. 5 is a view illustrating an example of a convection heater used in a convection assembly of an electric oven according to an embodiment of the present disclosure.

For example, as illustrated in FIG. 5, a heater 50' having a plurality of fins 53 formed on the outer surface of the circular heater 51 may be used as the convection heater 50. At this time, the plurality of fins 52 may be spaced apart from each other at a predetermined interval along the entire circumference of the heater 51. Alternatively, a single fin 52 having a long length may be provided in a helical shape along the outer circumferential surface of the heater 5. When the convection heater 50 is formed as the heater 50' as illustrated in FIG. 5, the contact area between the contaminants contained in the air and the heater 50' is increased, so that the contaminants contained in the air may be effectively removed and the efficiency of increasing the temperature of the air may be improved.

As another example, although not illustrated, a porous member may be provided on the outer surface of the bar or rod shaped convection heater 50. The porous member may be formed in the form of a metal mesh or a metal foam. When the porous member is provided on the surface of the convection heater 50 as described above, the contact area between the air and the convection heater 50 is increased, so that contaminant removal and air heating may be effectively performed.

Figure 6:
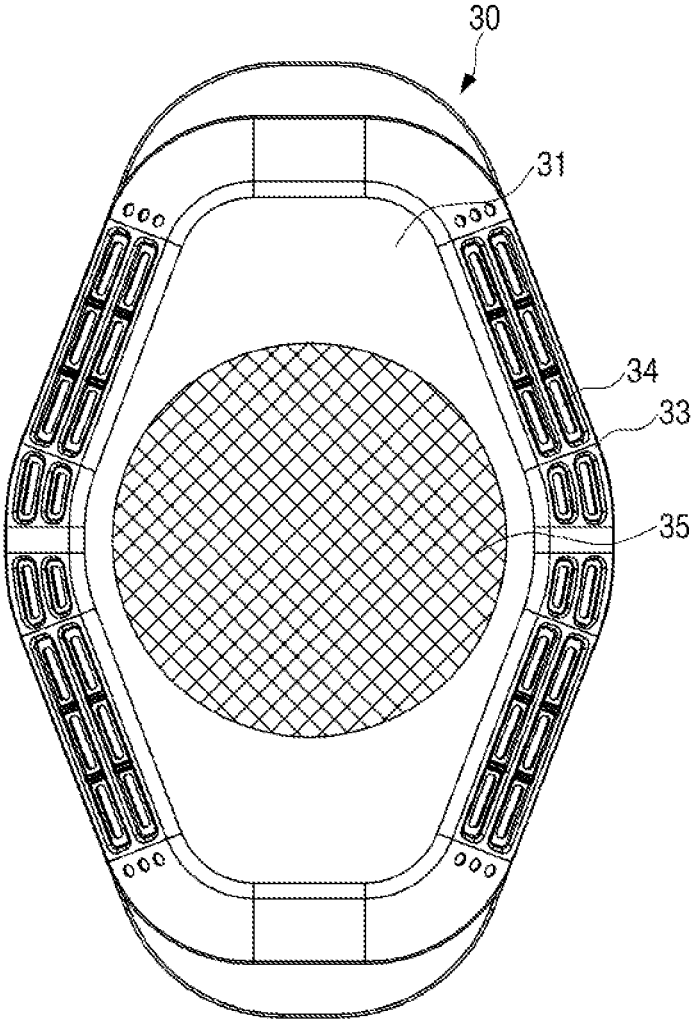
FIG. 6 is a view illustrating an example of a cover case of a convection assembly of an electric oven according to an embodiment of the present disclosure.

A porous member 35 may be provided at the inlet port 32 of the cover case 30 in order to enhance the contaminant removing efficiency of the convection assembly 20. FIG. 6 shows a case in which the porous member 35 is provided at the inlet port 32 of the cover case 30.

When the porous member 35 is provided at the inlet port 32 of the cover case 30 as described above, the contaminants contained in the air are stuck on the porous member 35 while air passes through the porous member 35, so that the contaminant removing efficiency may be increased. At this time, a metal mesh, a metal foam, or the like may be used as the porous member 35.

Figure 7:
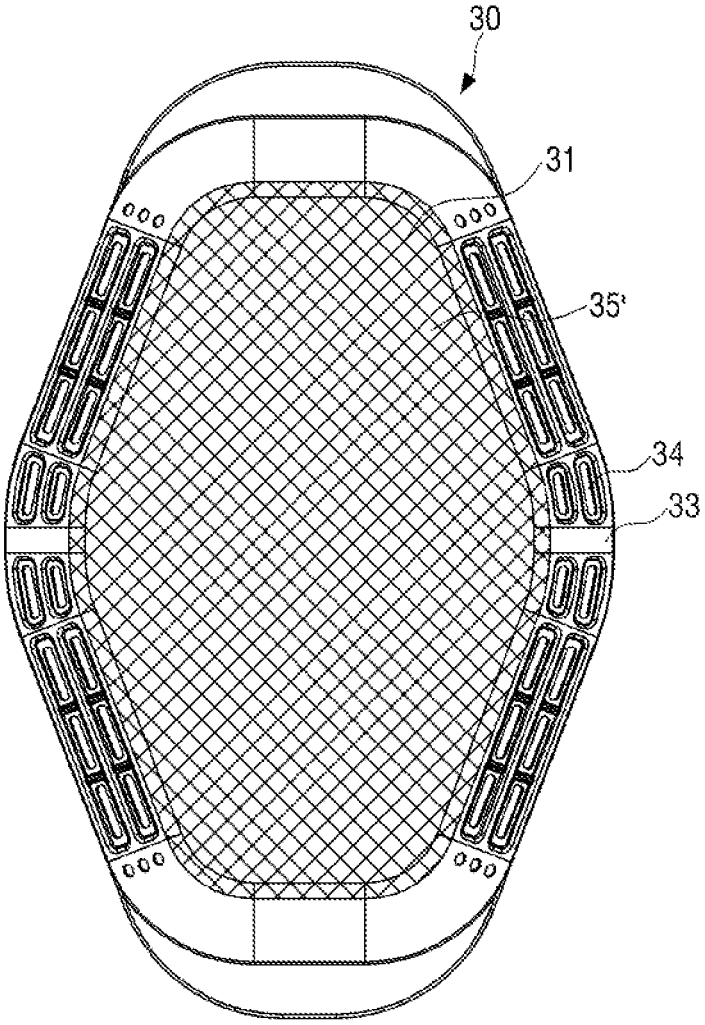
FIG. 7 is a view illustrating another example of a cover case of a convection assembly of an electric oven according to an embodiment of the present disclosure.

FIG. 6 shows the case in which the porous member 35 is provided only at the inlet port 32 of the cover case 30. However, the porous member 35 may be provided on the entire front surface 31 of the cover case 30. In other words, the front surface 31 of the cover case 30 may be formed of the porous member 35'. FIG. 7 shows a case in which the entire front surface 31 of the cover case 30 is formed of the porous member 35'. In this case, the air is drawn into the inside of the cover case 30 through the porous member 35' forming the front surface 31 of the cover case 30.

At this time, a catalyst may be provided on the porous member 35 and 35' in order to further increase the removal efficiency of the contaminants by the porous member 35 and 35'. At this time, the catalyst may be platinum (Pt), palladium (Pd), manganese oxide ($MnO_2$), or the like to effectively remove the contaminants.

Figure 8:
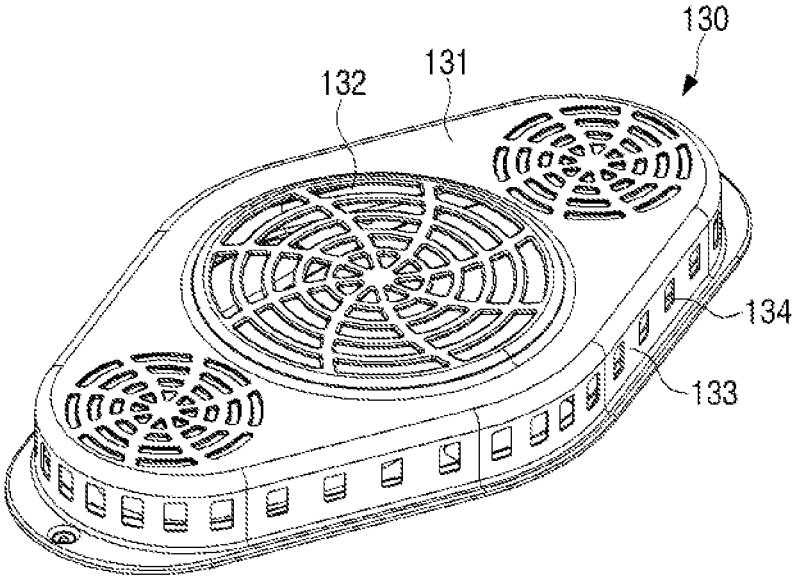
FIG. 8 is a view illustrating another example of a cover case of a convection assembly of an electric oven according to an embodiment of the present disclosure.
Figure 10:
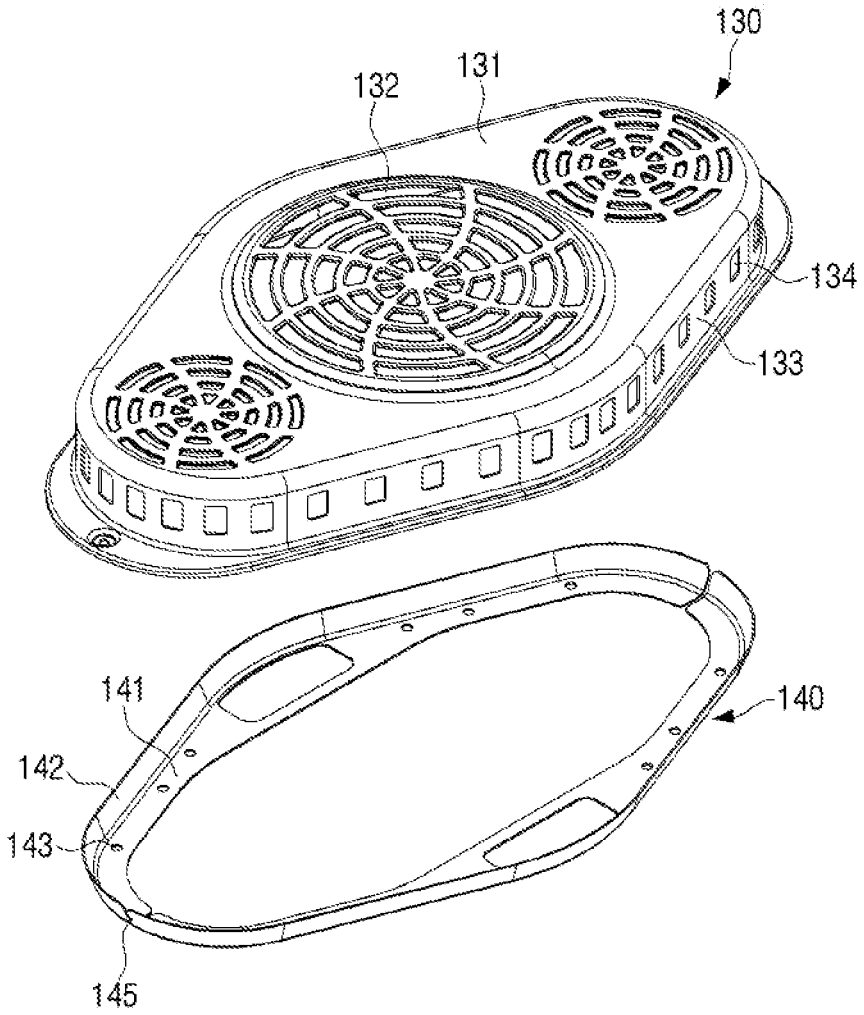
FIG. 10 is an exploded perspective view illustrating the cover case of FIG. 8.

FIG. 8 is a view illustrating another example of a cover case of a convection assembly of an electric oven according to an embodiment of the present disclosure, and FIG. 9 is a cross-sectional view of the cover case of FIG. 8. FIG. 10 is an exploded perspective view illustrating the cover case of FIG. 8.

Referring to FIGS. 8 to 10, a cover case 130 may include a front surface 131 provided with an inlet port 132 through which air flows in and a side surface 133 provided with a plurality of outlet ports 134 through which air is discharged.

At least one inlet port 132 is provided on the front surface 131 of the cover case 130. In the present embodiment, three inlet ports 132 are provided, but only one inlet port 132 may be provided like the cover case 30 as illustrated in FIG. 2.

The side surface 133 of the cover case 130 is formed to extend substantially at right angles with respect to the front surface 131. In the above-described embodiment, the side surface 33 of the cover case 30 is formed to be inclined with respect to the front surface 31 so that the air discharged from the outlet ports 34 does not directly contact the one surface 12 of the cavity 10 on which the cover case 30 is disposed. However, in the case of the cover case 130 according to the present embodiment, the side surface 133 is formed to be perpendicular to the front surface 131. When the side surface 133 is formed to be perpendicular to the front surface 131, air discharged from the outlet ports 134 may directly collide with the one surface 12 of the cavity 10. In order to prevent this, an inner barrier 140 is provided inside the cover case 130 in the case of the present embodiment.

The inner barrier 140 is provided in a space between the convection heater 50 and the side surface 133 of the cover case 130 and is formed so that the air discharged by the convection fan 40 collides with the inner barrier 140 and moves upward. In detail, the inner barrier 140 may include a fixed portion 141 and an inclined portion 142 as illustrated in FIG. 9.

The fixed portion 141 fixes the inner barrier 140 to the one surface 12 of the cavity 10. The fixed portion 141 has a plurality of through holes 143 formed therein. Therefore, the inner barrier 140 may be fixed to the one surface 12 of the cavity 10 with screws or bolts using the plurality of through holes 143.

The inclined portion 142 is formed to be inclined at a predetermined angle $\alpha$ with respect to the fixed portion 141. In other words, the inclined portion 142 is formed to be inclined upward toward the outer side with respect to the fixed portion 141. Also, the leading end 142*a* of the inclined portion 142 is formed to be adjacent to the lower ends 134*a* of the plurality of outlet ports 134. At this time, the inclined angle $\alpha$ of the inclined portion 142 may be appropriately set such that the air discharged in a direction parallel to the one surface 12 of the cavity 10 by the convection fan 40 collides with the inclined portion 142 of the inner barrier 140 and is discharged in an oblique direction toward the upper side of the one surface 12 of the cavity 10 through the plurality of outlet ports 134.

In addition, the inner barrier 140 may be provided with a discharge passage 145 so that the contaminants which collide with the inclined portion 142 and are collected in the inner barrier 140 flow downward.

Accordingly, the air discharged to the outside by the convection fan 40 disposed inside the inner barrier 140 collides with the inclined portion 142 of the inner barrier 140, moves upward, and then is discharged to the outside through the plurality of outlet ports 134. Therefore, even when the plurality of outlet ports 134 of the cover case 130 are formed at right angles with respect to the front surface 131 as in the present embodiment, the air coming out from the plurality of outlet ports 134 is discharged in an upward direction with respect to the one surface 12 of the cavity 10 so that the contaminants contained in the discharged air are not adhered to the one surface 12 of the cavity 10.

The inner barrier 140 may be formed to correspond to the entire circumference of the side surface 133 of the cover case 130. Alternatively, when the plurality of outlet ports 134 are formed only in a portion of the side surface 133 of the cover case 130, the inner barrier 140 may be formed to correspond to the portion of the side surface 133 of the cover case 130 in which the plurality of outlet ports 134 are formed.

When the inner barrier 140 is formed to correspond to the entire circumference of the side surface 133 of the cover case 130, the inner barrier 140 may be formed as a single part or as two or more parts. The inner barrier 140 shown in FIG. 10 is formed as two parts.

In the above description, the inner barrier 140 is provided inside the cover case 130 when the side surface 133 of the cover case 130 is perpendicular to the front surface 131 thereof. However, the inner barrier 140 may be provided even when the side surface of the cover case is inclined with respect to the front surface.

Figure 11:
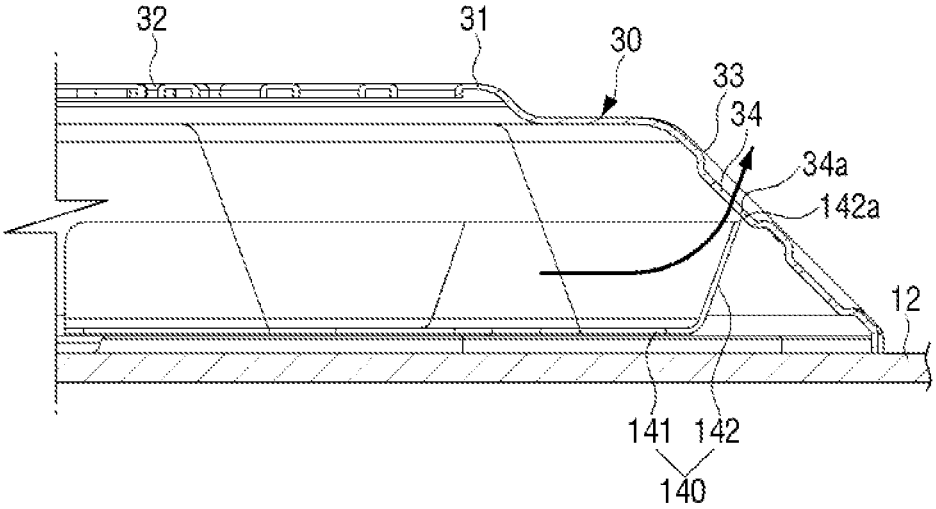
FIG. 11 is a partial cross-sectional view illustrating a case in which an inner barrier is disposed in a cover case having an inclined side surface.

FIG. 11 is a partial cross-sectional view illustrating a case in which an inner barrier is disposed in a cover case having an inclined side surface.

Referring to FIG. 11, an inner barrier 140 is provided inside a cover case 30. The cover case 30 is formed such that a side surface 33 thereof is inclined at a predetermined angle with respect to a front surface 31 thereof. The front surface 31 of the cover case 30 is provided with an inlet port 32 through which air is introduced and the side surface 33 of the cover case 30 is provided with a plurality of outlet ports 34 through which air is discharged.

The inner barrier 140 may include a fixed portion 141 fixed to the one surface 12 of the cavity 10 and an inclined portion 142 formed to be inclined upward from the fixed portion 141. The leading end 142*a* of the inclined portion 142 is formed adjacent to the lower ends 34*a* of the outlet ports 34 formed in the side surface 33 of the cover case 30. Accordingly, the air discharged by the convection fan 40 disposed inside the cover case 30 moves in an upward inclined direction by the inclined portion 142 of the inner barrier 140 and is discharged to the outside of the cover case 30 through the plurality of outlet ports 34 provided in the side surface 33 of the cover case 30. At this time, the air discharged from the cover case 30 is guided by the inclined portion 142 of the inner barrier 140 and the side surface 33 of the cover case 30, thereby being discharged in the upward inclined direction with the one surface 12 of the cavity 10.

The air containing contaminants sucked into the convection assembly 20 is heated while passing through the convection heater 50. After the heated air is discharged through the outlet ports 34 of the cover case 30, the temperature of the heated air is lowered, and then oil mist contained in the air condenses so that solid contaminants may be formed around the convection assembly 20 on the one surface 12 of the cavity 10. At this time, the components of the convection assembly 20 may be arranged such that the oil mist contained in the air is condensed inside the cover case 30 without condensation outside the cover case 30.

Figure 12A:
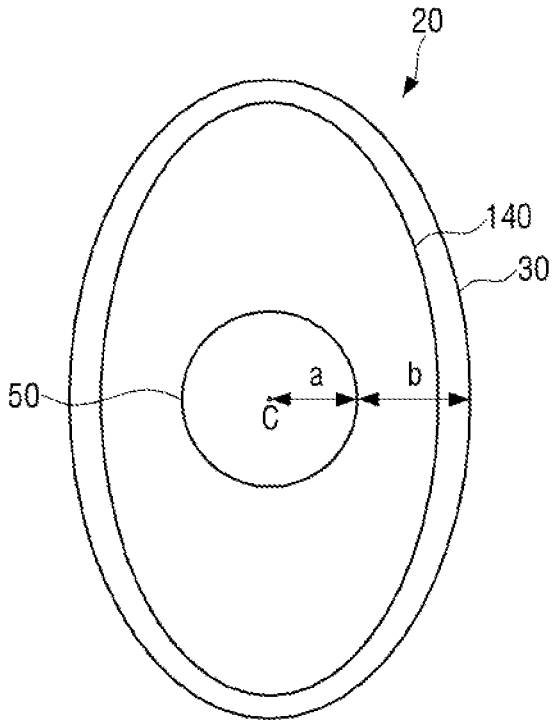
FIGS. 12A and 12B are views for explaining the relationship between a convection heater, an inner barrier, and a cover case of a convection assembly of an electric oven according to an embodiment of the present disclosure.
Figure 12B:
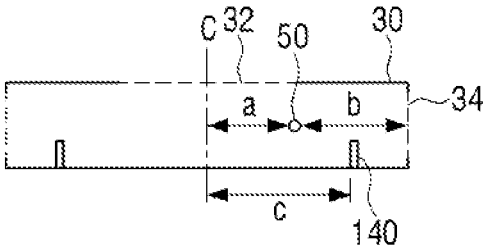

FIGS. 12A and 12B are views for explaining the relationship between a convection heater, an inner barrier, and a cover case of a convection assembly of an electric oven according to an embodiment of the present disclosure. FIG. 12A is a plan view conceptually illustrating the convection assembly, and FIG. 12B is a partial cross-sectional view conceptually illustrating the convection assembly.

Hereinafter, an arrangement of a convection heater 50, an inner barrier 140, and a cover case 30 that can prevent the oil mist contained in the air discharged from the convection assembly 20 from condensing on the outside of the cover case 30 to form contaminant will be described with reference to FIGS. 12A and 12B.

When the distance from the center C of the inlet port 32 of the cover case 30 to the outlet port 34 is 1, the position of the convection heater 50 may be set to be smaller than 0.5. Further, the barrier 140 with which the air collides is provided between the convection heater 50 and the outlet ports 34. In detail, $$a+b=1$$

$$a\leq 0.5$$

$$a\leq c\leq 1$$

Here, a is the distance from the center of the inlet port 32 to the convection heater 50, b is the distance from the convection heater 50 to the outlet ports 34, and c is the distance from the center of the inlet port 32 to the barrier 140. Therefore, the barrier 140 is disposed between the convection heater 50 and the outlet ports 34.

When the convection heater 50, the barrier 140, and the cover case 30 are disposed on the one surface 12 of the cavity 10 so as to satisfy the above-described conditions, the oil mist is condensed inside the cover case 30 on the one surface 12 of the cavity 10. Therefore, the contamination formed by condensation of the oil mist is not generated on the one surface 12 of the cavity 10 around the outer circumference of the cover case 30.

Hereinafter, another example of a cover case of a convection assembly of an electric oven according to an embodiment of the present disclosure will be described with reference to FIGS. 13 and 14.

Figure 14:
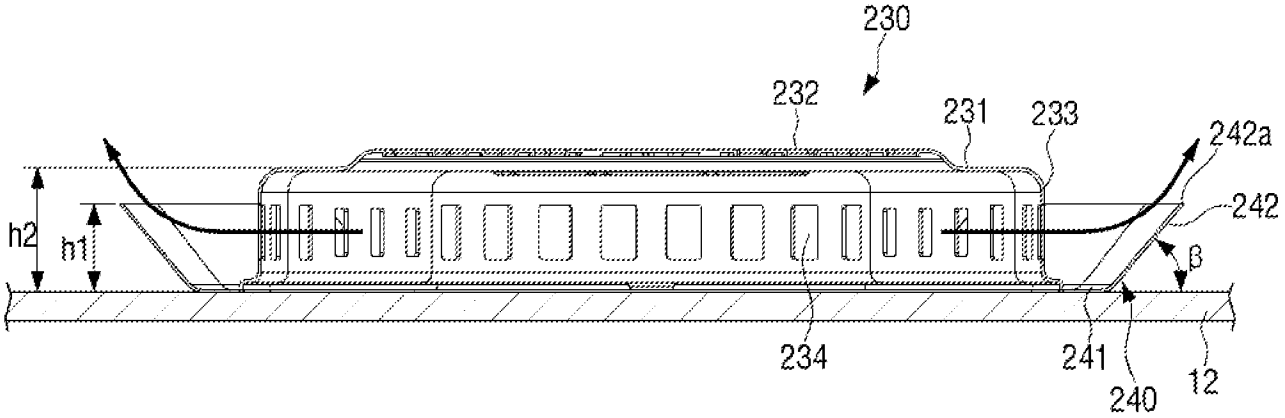
FIG. 14 is a cross-sectional view illustrating the cover case of FIG. 13.

FIG. 13 is a perspective view illustrating another example of a cover case of a convection assembly of an electric oven according to an embodiment of the present disclosure, and FIG. 14 is a cross-sectional view illustrating the cover case of FIG. 13.

Referring to FIGS. 13 and 14, a cover case 230 may include a front surface 231, a side surface 233, and an outer barrier 240.

The front surface 231 of the cover case 230 is provided with at least one inlet port 232 through which air is sucked. In the case shown in FIG. 13, three inlet ports 232 are provided on the front surface 231 of the cover case 230. However, the number of the inlet ports 232 is not limited thereto. Only one inlet port 232 may be provided like the cover case 30 shown in FIG. 2.

The side surface 233 of the cover case 230 is formed to extend substantially at right angles with respect to the front surface 231 thereof. The side surface 233 of the cover case 230 is provided with a plurality of outlet ports 234. Therefore, the outlet ports 234 are formed perpendicular to the one surface 12 of the cavity 10 in which the cover case 230 is disposed. When the outlet ports 234 of the cover case 230 are formed to be perpendicular to the one surface 12 of the cavity 10 as described above, the air discharged from the outlet ports 234 may collide directly with the one surface 12 of the cavity 10. In order to prevent this, the outer barrier 240 is provided around the outer circumference of the cover case 230 in this embodiment.

The outer barrier 240 is disposed along the outer circumferential surface of the cover case 230 and is formed so that the air discharged through the plurality of outlet ports 234 by the convection fan 40 collides with the outer barrier 240 and moves in the upward direction with respect to the one surface 12 of the cavity 10. In detail, the outer barrier 240 may include a connecting portion 241 and an inclined portion 242, as illustrated in FIGS. 13 and 14.

The connecting portion 241 extends outward from the side surface 233 of the cover case 230 and allows the outer barrier 240 to be connected to the cover case 230. The connecting portion 241 of the outer barrier 240 extends at right angles with respect to the side surface 233 of the cover case 230 from the entire circumference of the cover case 230. Therefore, when the cover case 230 is disposed on the one surface 12 of the cavity 10, the connecting portion 241 is in contact with the one surface 12 of the cavity 10.

The inclined portion 242 of the outer barrier 240 extends outwardly from the connecting portion 241 and is formed to be inclined at a predetermined angle β with respect to the connecting portion 241. In other words, the inclined portion 242 is formed to be inclined upward in the outward direction with respect to the connecting portion 241. The angle β of inclination of the inclined portion 242 may be appropriately determined such that the air discharged in parallel to the top surface of the connecting portion 241 through the outlet ports 234 of the side surface 233 of the cover case 230 collides with the inclined portion 242 of the outer barrier 240 and moves in an upward inclined direction with respect to the cover case 230. On the other hand, the height h1 of the leading end 242*a* of the inclined portion 242 may be lower than the height h2 of the front surface 231 of the cover case 230 as illustrated in FIG. 14.

Accordingly, the air discharged through the plurality of outlet ports 234 by the convection fan 40 provided inside the cover case 230 moves along the connecting portion 241 of the outer barrier 240, collides with the inclined portion 242, and then moves in the upward direction. Therefore, even when the plurality of outlet ports 234 of the cover case 230 are formed at right angles with respect to the one surface 12 of the cavity 10 as in the present embodiment, the air coming out from the plurality of outlet ports 234 is discharged in the upward direction with respect to the one surface 12 of the cavity 10. In the present embodiment, the air discharged from the plurality of outlet ports 234 of the cover case 230 does not collide with the one surface 12 of the cavity 10 so that even when contaminants are contained in the air discharged from the plurality of outlet ports 234 of the cover case 230, the contaminants do not adhere to the one surface 12 of the cavity 10. Therefore, the inside of the cavity 10 is not contaminated.

In the above description, the air discharged from the convection assembly 20 is prevented from directly colliding with the one surface 12 of the cavity 10 to prevent contamination of the cavity 10. Hereinafter, a case of preventing the contamination of the cavity 10 by reducing the amount of contaminants discharged from the convection assembly 20 will be described.

Figure 15:
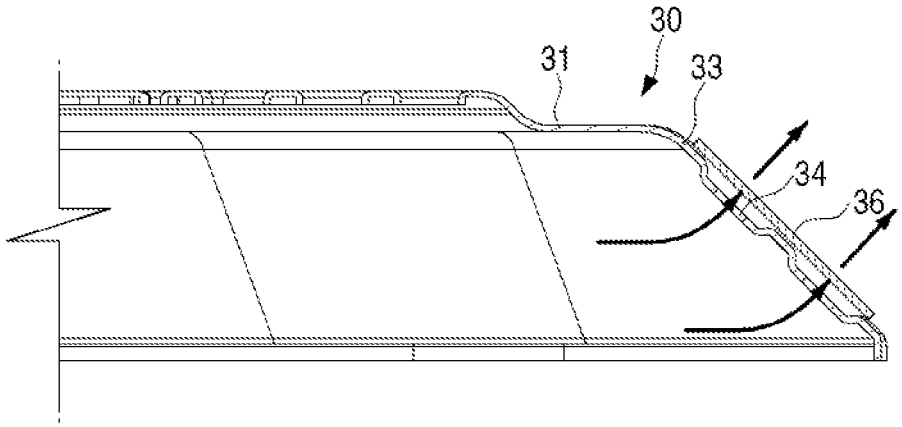
FIG. 15 is a cross-sectional view illustrating another example of a cover case of a convection assembly of an electric oven according to an embodiment of the present disclosure.

FIG. 15 is a cross-sectional view illustrating another example of a cover case of a convection assembly of an electric oven according to an embodiment of the present disclosure.

Referring to FIG. 15, a porous member 36 is provided on the side surface 33 of the cover case 30 of the convection assembly 20.

The contaminants contained in the air introduced into the cover case 30 of the convection assembly 20 are burned and removed by the convection heater 50 provided inside the cover case 30 as in the above-described embodiment. However, some of the contaminants may not be removed by the convection heater 50 but may be discharged to the outside through the outlet ports 34 of the cover case 30 together with the air.

When the porous member 36 is provided outside the plurality of outlet ports 34 of the side surface 33 of the cover case 30 as illustrated in FIG. 15, the contaminants contained in the air are attached to the porous member 36 while the air passes through the porous member 36, so that the amount of the oil mist contained in the air discharged from the convection assembly 20 may be reduced. At this time, the porous member 36 may be a metal mesh, a metal foam, or the like.

FIG. 15 shows the case in which the porous member 36 is provided outside the plurality of outlet ports 34 of the cover case 30. However, the porous member 36 may be provided inside the plurality of outlet ports 34.

Also, FIG. 15 shows the case in which the porous member 36 is provided only on the plurality of outlet ports 34 of the cover case 30. However, as another example, the entire side surface 33 of the cover case 30 may be formed of a porous member.

In addition, a catalyst may be provided on the porous member 36 in order to further increase the removal efficiency of the contaminants by the porous member 36. At this time, platinum (Pt), palladium (Pd), manganese oxide ($MnO_2$), or the like may be used as the catalyst to effectively remove the contaminants such as oil mist.

The convection assembly 20 in which the sucked air is moved to the convection heater 50 through the convection fan 40, that is, the convection heater 50 is provided downstream of the convection fan 40 has been described in the above. However, the convection heater 50 may be provided upstream of the convection fan 40.

Hereinafter, a convection assembly in which a convection heater is provided upstream of a convection fan will be described with reference to FIG. 16.

Figure 16:
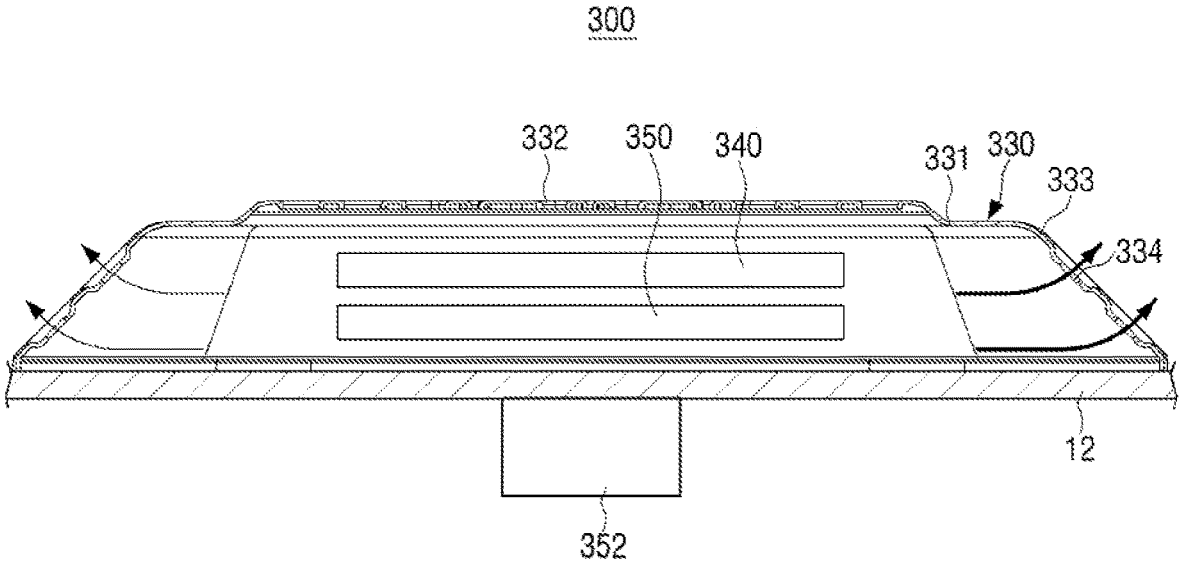
FIG. 16 is a view conceptually illustrating another example of a convection assembly of an electric oven according to an embodiment of the present disclosure.
Figure 17:
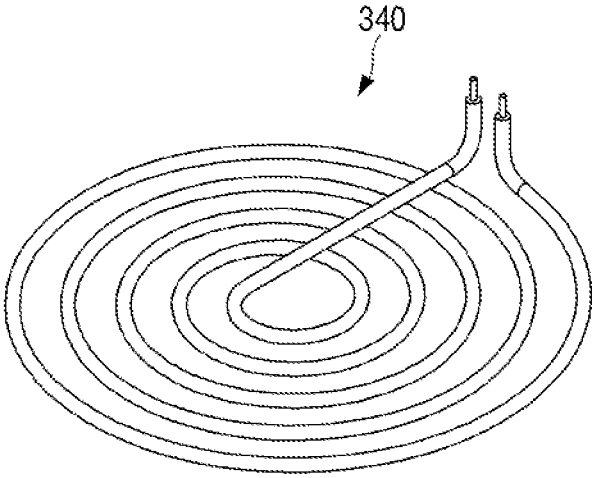
FIG. 17 is a perspective view illustrating an example of a convection heater used in the convection assembly of FIG. 16.
Figure 18:
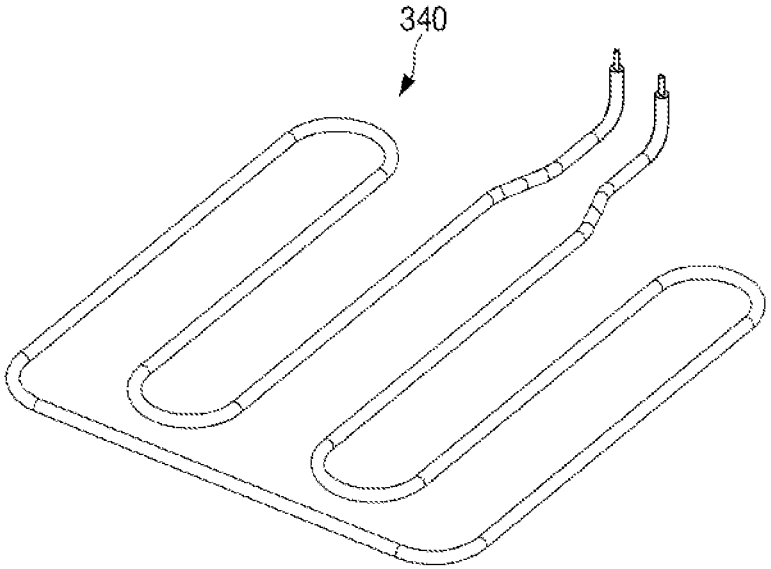
FIG. 18 is a perspective view illustrating another example of a convection heater used in the convection assembly of FIG. 16.

FIG. 16 is a view conceptually illustrating a convection assembly of an electric oven in which a convection heater is provided upstream of a convection fan. FIG. 17 is a perspective view illustrating an example of the convection heater used in the convection assembly of FIG. 16, and FIG. 18 is a perspective view illustrating another example of the convection heater used in the convection assembly of FIG. 16.

Referring to FIG. 16, a convection assembly 300 according to an embodiment of the present disclosure may include a cover case 330, a convection heater 340, and a convection fan 350.

The cover case 330 is provided to cover the convection heater 340 and the convection fan 350 and prevents a user's hand, food and utensil or the like from contacting the convection heater 340 and the convection fan 350. A front surface 331 of the cover case 330 is provided with an inlet port 332 through which the air inside the cavity 10 is drawn and a side surface 333 of the cover case 330 is provided with a plurality of outlet ports 334 through which the air discharged by the convection fan 350 passes. The side surface 333 of the cover case 330 is formed to be inclined at a predetermined angle with respect to the bottom surface thereof. Therefore, the air discharged through the plurality of outlet ports 334 of the inclined side surface 333 by the convection fan 350 does not directly collide with the one surface 12 of the cavity 10 but flows in the upward inclined direction with respect to the one surface 12 of the cavity 10.

The convection heater 340 is disposed adjacent to the inlet port 332 provided in the front surface 331 of the cover case 330. Therefore, the air passing through the inlet port 332 of the cover case 330 passes by the convection heater 340 and moves to the convection fan 350. At this time, contaminants such as oil mist contained in the air come into contact with the surface of the convection heater 340 and contaminate the surface of the convection heater 340. However, the contaminants in contact with the convection heater 340 are burned and removed by the surface of the heated convection heater 340. Accordingly, the air in which most contaminants are removed moves to the convection fan 350.

At this time, the convection heater 340 may be formed in various shapes to increase the contact area with the air. For example, as illustrated in FIG. 17, the convection heater 340 may be formed in a spiral structure. Alternatively, as illustrated in FIG. 18, the convection heater 340 may be formed in a U-band structure including a plurality of U-shaped portions. Alternatively, as illustrated in FIG. 5, a plurality of fins may be formed on the outer circumferential surface of the convection heater 340.

The convection fan 350 is provided below the convection heater 340 and sucks the air inside the cavity 10 into the inside of the cover case 330 and discharges it to the outside thereof. In other words, the convection fan 350 allows the air containing the contaminants to be sucked into the inside of the cover case 330 through the inlet port 332 of the cover case 330 and the air in which the contaminants are removed while passing the convection heater 340 to be discharged to the outside through the outlet ports 334 of the cover case 330. Accordingly, the convection fan 350 functions to circulate the air inside the cavity 10. The convection fan 350 may be configured to suck air in the center thereof and discharge the air in the radial direction thereof. The convection fan 350 is rotated by a motor 352 provided below the one surface 12 of the cavity 10.

When the convection heater 340 is provided on the upstream side of the convection fan 350 as illustrated in FIG. 16, the air from which the contaminants are removed moves to the convection fan 350. Therefore, contamination of the convection fan 350 may be reduced more than when the convection heater 50 is provided downstream of the convection fan 40 as illustrated in FIG. 4.

The method of reducing the contamination inside the cavity 10 by removing the contaminants contained in the air sucked into the convection assembly 300 has been described in the above. Hereinafter, an internal structure of the cavity 10 capable of facilitating cleaning of contaminants adhered to the inside of the cavity 10 will be described.

Referring to FIG. 1, a plurality of rack supporting protrusions 410 configured to support a rack 400 are provided on both side surfaces of the cavity 10. The rack 400 supports the food inside the cavity 10, and may be formed of a metal wire or the like.

Each of the plurality of rack supporting protrusions 410 may include a lower supporting protrusion 411 and an upper supporting protrusion 412. The rack 400 is positioned between the lower supporting protrusion 411 and the upper supporting protrusion 412. The lower supporting protrusion 411 is formed parallel to the bottom surface of the cavity 10 and includes at least two protrusions 411*a*, 411*b*, and 411*c* spaced apart by predetermined intervals in the horizontal direction. In the embodiment shown in FIG. 1, three lower supporting protrusions 411*a*, 411*b*, and 411*c* are formed on both side surfaces of the cavity 10. The gap g between the at least two lower supporting protrusions 411*a*, 411*b*, and 411*c* is formed to be larger than the length w1 of the one lower supporting protrusion 411. Each of the lower supporting protrusions 411 is formed so that contaminants do not catch on the upper side of the outer circumferential surface thereof and can flow downward. For example, the lower supporting protrusion 411 may be formed as a protrusion whose outer circumferential surface is a curved surface.

The upper supporting protrusion 412 is provided between the two lower supporting protrusions 411*a* and 411*b* at a position higher than the lower supporting protrusions 411*a* and 411*b*. In other words, the upper supporting protrusion 412 is formed to be vertically spaced apart from the at least two lower supporting protrusion 411*a* and 411*b*. Further, the length w2 of the upper supporting protrusion 412 is formed to be smaller than the gap g between the two lower supporting protrusions 411*a* and 411*b*. The upper supporting protrusion 412 may be formed in such a shape that contaminants do not catch on the outer surface thereof and flow downward. For example, the upper supporting protrusion 412 may be formed in a protruding shape whose outer circumferential surface is a curved surface and inclined downwardly.

At least two rack supporting protrusions 410 including the lower supporting protrusion 411 and the upper supporting protrusion 412 may be provided in the vertical direction. The electric oven 1 shown in FIG. 1 has seven rack supporting protrusions 410.

Each of the plurality of rack supporting protrusions 410 according to the present disclosure is formed in a shape cut in the horizontal direction so that the contaminants adhering to the side surface 14 of the cavity 10 may easily flow downward through the spaces between the rack supporting protrusions 410 as shown by arrows A in FIG. 1. Therefore, the present disclosure may prevent the contaminants from sticking between the plurality of rack supporting protrusions in the conventional electric oven.

Figure 19:
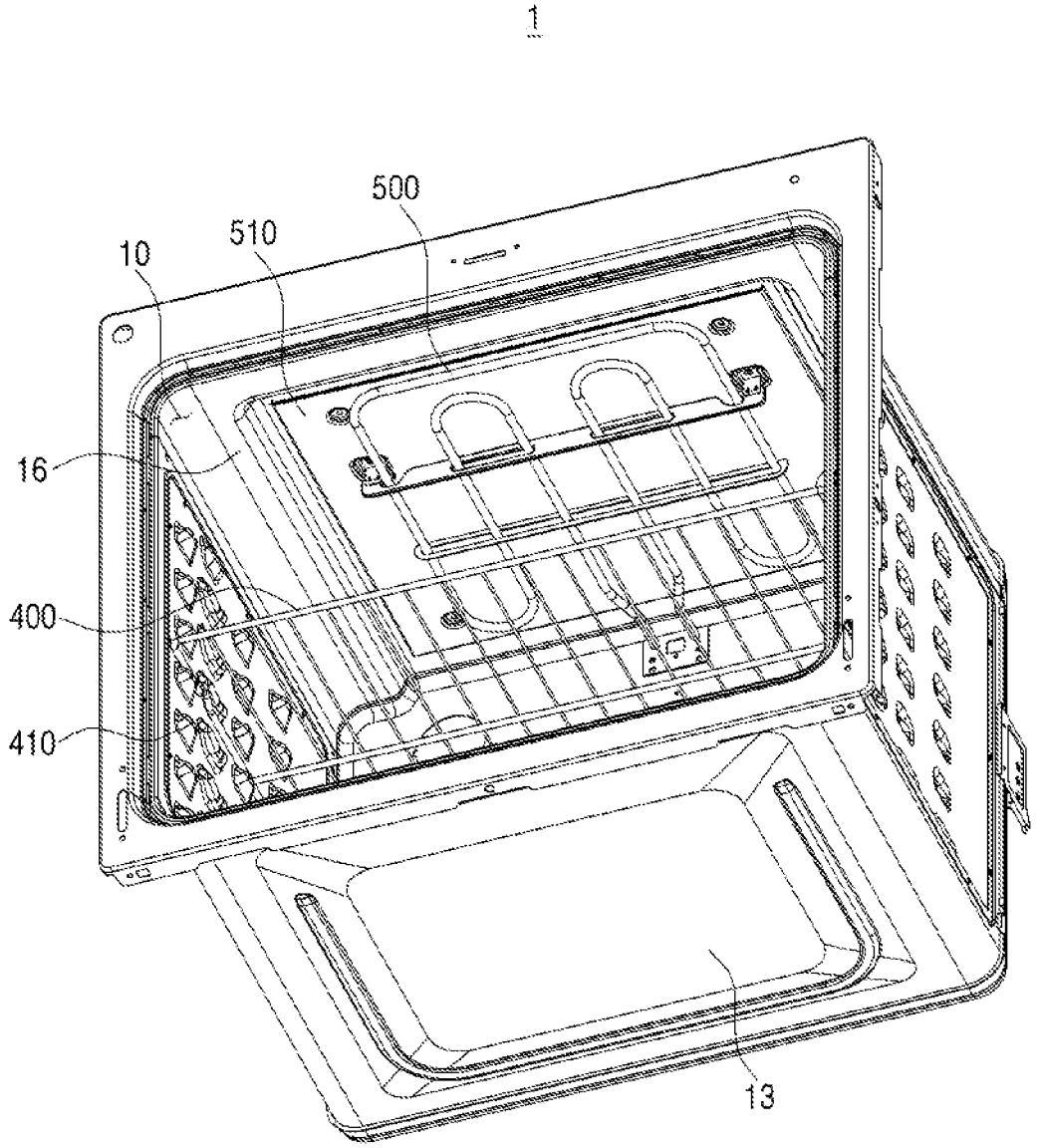
FIG. 19 is a perspective view illustrating a convection assembly of an electric oven according to an embodiment of the present disclosure.

FIG. 19 is a bottom perspective view illustrating an electric oven according to an embodiment of the present disclosure.

Referring to FIG. 19, an electric oven 1 according to an embodiment of the present disclosure is provided with an upper heater 500 for heating the inside of the cavity 10 on the upper surface 16 of the cavity 10. In addition, a shield plate 510 is disposed between the upper surface 16 of the cavity 10 and the upper heater 500.

The shield plate 510 may be detachably provided on the upper surface 16 of the cavity 10. In detail, after the upper heater 500 is detached, the shield plate 510 is disposed to be detachable from the upper surface 16 of the cavity 10. The shield plate 510 may be formed of a thin metal plate.

In the case in which the shield plate 510 is disposed between the upper surface 16 of the cavity 10 and the upper heater 500, when contaminants generated from the food splash toward the upper heater 500, the contaminants are attached to the shield plate 510. At this time, since the shield plate 510 is disposed close to the upper heater 500, the contaminants attached to the shield plate 510 are decomposed and removed by the heat generated in the upper heater 500. When the contaminants attached to the shield plate 510 are not removed by the heat of the upper heater 500, the shield plate 510 is disassembled from the upper surface 16 of the cavity 10 and then the contaminants may be removed from the shield plate 510. Therefore, in the electric oven 1 according to the present embodiment, the contaminants attached to the upper surface 16 of the cavity 10 may be easily removed.

Referring again to FIG. 1, the bottom surface 13 of the cavity 10 is formed as a concave portion whose central portion is lower than the peripheral portion thereof. At this time, the bottom surface of the concave portion 13 may be formed to be inclined downward from the one surface 12 of the cavity 10 on which the convection assembly 300 is disposed to the side where the opening 11 is formed. When the bottom surface of the concave portion 13 is inclined downward toward the front side as described above, the contaminants in the concave portion 13 are collected toward the opening 11, so that cleaning is easy.

In addition, a contaminant collecting groove 19 is formed adjacent to the both side surfaces 14 and 15 of the cavity 10 on which the plurality of rack supporting protrusions 410 are formed and the one surface (rear surface) 12 of the cavity 10 on which the convection assembly 20 is provided on the inclined surface of the concave portion 13. As illustrated in FIGS. 1 and 19, the contaminant collecting groove 19 is formed in a long groove having a substantially flattened U-shape. Therefore, the contaminants flowing down from the both side surfaces 14 and 15 and the rear surface 12 of the cavity 10 are gathered in the contaminant collecting groove 19, so that the contaminants may be easily cleaned. When the contaminant collecting groove 19 is not provided on the bottom surface of the cavity as in the conventional electric oven, contaminants flowing down from both side surfaces and the rear surface of the cavity spread widely on the bottom surface of the cavity, so that the cleaning area is widened and the removal of the contaminants is not easy.

Hereinafter, a cleaning method of an electric oven according to an embodiment of the present disclosure having the above-described structure will be described.

Figure 20:
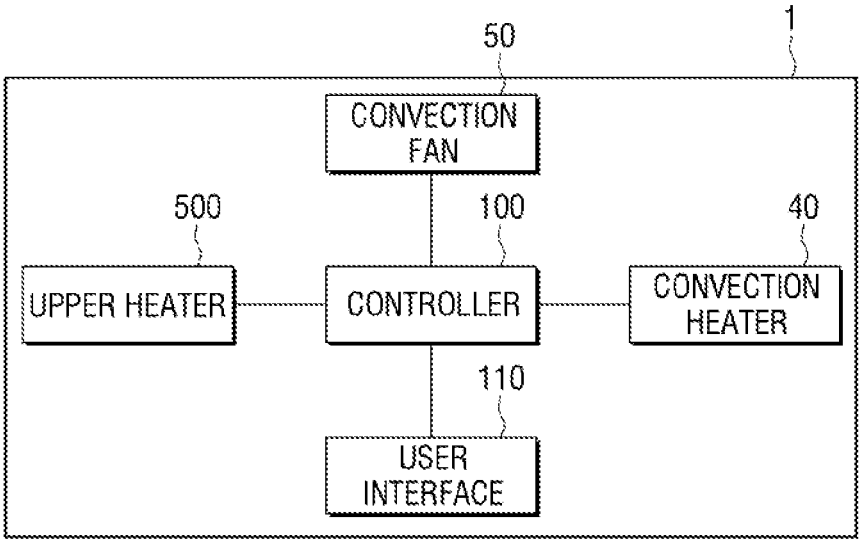
FIG. 20 is a functional block diagram of an electric oven according to an embodiment of the present disclosure.

FIG. 20 is a functional block diagram of an electric oven according to an embodiment of the present disclosure.

An electric oven 1 according to an embodiment of the present disclosure may include a convection fan 50, a convection heater 40, an upper heater 500, a user interface 110, and a controller 100.

The convection fan 50 is provided on the one surface 12 of the cavity 10, forms the above-described convection assembly 20 together with the convection heater 40, and functions to circulate air inside the cavity 10.

The convection heater 40 heats the air sucked by the convection fan 50. While the convection heater 40 heats the air, contaminants such as oil mist contained in the air are burned and removed.

The upper heater 500 is disposed on the upper surface 16 of the cavity 10 and heats the food.

The user interface 110 is provided with a plurality of buttons or keys so that the user can input necessary commands to the electric oven 1. In addition, the user interface 110 may include a display configured to display the status of the electric oven 1.

The controller 100 controls the convection heater 40, the convection fan 50, and the upper heater 500 according to the user's command input through the user interface 110. The controller 100 is configured to perform a cooking mode for cooking food and a cleaning mode for cleaning the inside of the cavity 10.

The controller 100 may perform an operation of removing contaminants during the cooking mode in order to minimize the contamination of the inside of the cavity 10 by the contaminants such as oil mist generated in the cooked food during cooking. When the controller 100 controls the convection heater 40 to be heated to the maximum temperature, the contaminants attached to the surface of the convection heater 40, the inlet port 32 of the cover case 30, and the outlet ports 34 of the cover case 30 are burned, so that the contaminants generated during cooking may be removed.

Therefore, in order to reduce the amount of contaminants generated during cooking, the controller 100 may control the convection heater 40 so that the convection heater 40 is heated to the maximum temperature for a predetermined time and then returned to the cooking temperature at least once during cooking of the food.

Figure 21:
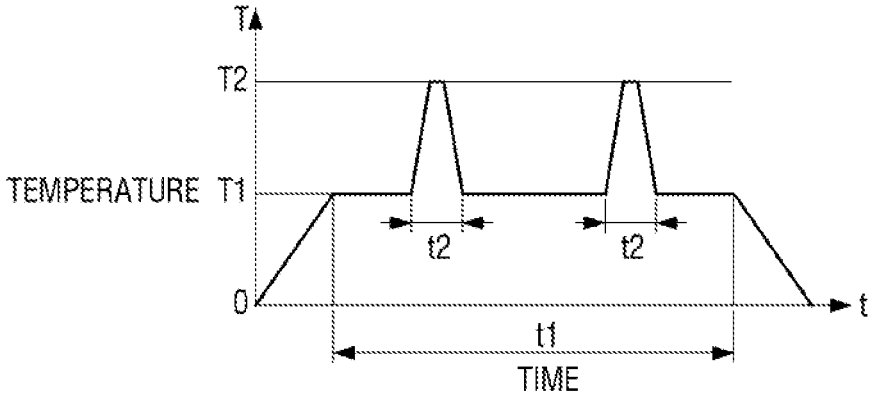
FIG. 21 is a graph for explaining a cleaning operation in a cooking mode of an electric oven according to an embodiment of the present disclosure.

For example, referring to FIG. 21, the controller 100 raises the temperature of the convection heater 40 to the cooking temperature T1 and maintains the temperature for a predetermined time t1 in order to cook the food. While maintaining the cooking temperature, the controller 100 performs the cleaning operation twice in which the convection heater 40 is heated to the maximum temperature T2 and returns to the cooking temperature again. At this time, the cleaning operation is set to be performed for a short time t2 compared to the cooking time t1. When the cleaning operation is performed in the cooking mode as described above, the amount of contaminants generated during the cooking mode and adhering to the convection heater 40, and the inlet port 32 and the outlet ports 34 of the cover case 30 may be reduced. In the embodiment of FIG. 21, the cleaning operation is performed twice in the cooking mode. However, the number of cleaning operations is not limited thereto. For example, the controller 100 may perform the cleaning operation once or three times or more during the cooking mode.

When the electric oven 1 is used for a long time, contaminants such as oil mist generated in the food are adhered to the inside of the cavity 10. In order to remove this, the user may operate the electric oven 1 in the cleaning mode. The cleaning mode is performed separately from the cooking mode. In other words, the cleaning mode may be performed while the cooking mode is not performed.

When performing the cleaning mode, the controller 100 heats the convection heater 40 and the upper heater 500 to the maximum temperature. When the convection heater 40 is heated to the maximum temperature, contaminants attached to the surface of the convection heater 40 and contaminants attached to the inlet port 32 and the outlet ports 34 of the cover case 30 are burned and removed. In addition, when the upper heater 500 is heated to the maximum temperature, contaminants attached to the surface of the upper heater 500 and contaminants attached to the shield plate 510 are burned and removed. An operation ratio of the convection heater 40 may be set to be higher than an operation rate of the upper heater 500 when performing the cleaning mode.

The present disclosure has been described above by way example. The terms used herein are for the purpose of description and should not be construed as limiting. Various modifications and variations of the present disclosure are possible in light of the above teachings. Therefore, the present disclosure can be freely carried out within the scope of the claims unless otherwise specified.

The invention claimed is:

1. An electric oven comprising:

an oven main body forming a cavity in which food is received; and a convection assembly provided to protrude from one surface of the cavity and configured to suck and remove contaminants generated when cooking the food and to heat an inside of the cavity, wherein the convection assembly comprises:

a cover case protruding from the one surface of the cavity, the cover case including a front surface spaced apart from the one surface of the cavity and having an inlet port and a side surface extending from the front surface to the one surface of the cavity and having outlet ports;

a convection fan provided inside the cover case, the convection fan configured to allow air containing the contaminants to be sucked into the cover case through the inlet port and to be discharged through the outlet ports;

a convection heater configured to heat the air sucked into the cover case by the convection fan and to remove the contaminants; and a barrier disposed between the convection heater and the side surface of the cover case, the barrier extending at an oblique angle from the one surface of the cavity in a manner that the air discharged by the convection fan collides with the barrier and is diverted in an upward inclined direction with respect to the one surface of the cavity towards the outlet port.

2. The electric oven of claim 1, wherein the side surface of the cover case is inclined with respect to the one surface of the cavity.

3. The electric oven of claim 1, wherein the barrier comprises a discharge passage configured to discharge contaminants collected by the barrier.

4. The electric oven of claim 1, wherein:

the convection heater is disposed to surround the convection fan, and a straight distance from a center of the inlet port of the cover case to the convection heater is smaller than a straight distance from the convection heater to the outlet ports of the cover case.

5. The electric oven of claim 1, wherein the convection heater is disposed downstream of the convection fan in a flow direction of the air, and wherein a porous member is provided on the inlet port of the cover case or on the front surface of the cover case.

6. The electric oven of claim 1, wherein the convection heater is disposed upstream of the convection fan in a flow direction of the air.

7. The electric oven of claim 6, wherein the convection heater comprises at least one of: at least one fin, a metal mesh, and a metal foam provided on an outer surface of the convection heater.

8. The electric oven of claim 1, further comprising:

a plurality of rack supporting protrusions provided on both side surfaces of the cavity, wherein each of the plurality of rack supporting protrusions comprises:

at least two lower supporting protrusions provided parallel to a bottom surface of the cavity and spaced apart from each other by a predetermined interval; and an upper supporting protrusion disposed between the at least two lower supporting protrusions and spaced apart upward from the at least two lower supporting protrusions.

9. The electric oven of claim 8, wherein the predetermined interval between the at least two lower supporting protrusions is greater than a length of each of the at least two lower supporting protrusions.

10. The electric oven of claim 1, further comprising:

an upper heater provided on an upper surface of the cavity; and a shield plate provided between the upper surface of the cavity and the upper heater.

11. The electric oven of claim 10, wherein the shield plate is detachably provided on the upper surface of the cavity.

12. The electric oven of claim 1, further comprising:

a controller configured to control the convection heater, wherein the controller controls the convection heater, and the convection heater is heated to a maximum temperature and returned to a cooking temperature at least once while cooking the food.

13. An electric oven comprising:

an oven main body forming a cavity in which food is received; and a convection assembly provided to protrude from one surface of the cavity and configured to suck and remove contaminants generated when cooking the food and to heat an inside of the cavity, wherein the convection assembly comprises:

a cover case protruding from the one surface of the cavity, the cover case including a front surface spaced apart from the one surface of the cavity and having an inlet port and a side surface extending from the front surface to the one surface of the cavity and having outlet ports;

a convection fan provided inside the cover case, the convection fan configured to allow air containing the contaminants to be sucked into the cover case through the inlet port and to be discharged through the outlet ports;

a convection heater configured to heat the air sucked into the cover case by the convection fan and to remove the contaminants; and an outer barrier provided around the cover case and formed to corresponding to an entire circumference of the cover case, the outer barrier extending at an oblique angle from the one surface of the cavity in a manner that the air discharged from the outlet ports of the cover case collides with the outer barrier and is diverted in an upward inclined direction with respect to the one surface of the cavity.

14. An electric oven comprising:

an oven main body forming a cavity in which food is received; and a convection assembly provided to protrude from one surface of the cavity and configured to suck and remove contaminants generated when cooking the food and to heat an inside of the cavity, wherein the convection assembly comprises:

a cover case protruding from the one surface of the cavity, the cover case including a front surface spaced apart from the one surface of the cavity and having an inlet port and a side surface extending from the front surface to the one surface of the cavity and having outlet ports;

a convection fan provided inside the cover case, the convection fan configured to allow air containing the contaminants to be sucked into the cover case through the inlet port and to be discharged through the outlet ports;

a convection heater configured to heat the air sucked into the cover case by the convection fan and to remove the contaminants; and a barrier disposed between the convection heater and the side surface of and extending from the one surface of the cavity, wherein the air discharged by the convection fan collides with the barrier and then is discharged through the outlet ports in an upward inclined direction with respect to the one surface of the cavity, wherein a bottom surface of the cavity is inclined downward from a rear surface of the cavity towards a front side of the cavity, and wherein a contaminant collecting groove is formed adjacent to both side surfaces and the rear surface of the cavity.

* * * * *